US006217395B1

(12) United States Patent
Flieger et al.

(10) Patent No.: US 6,217,395 B1
(45) Date of Patent: Apr. 17, 2001

(54) CONTACT SPRING AND RECEPTACLE CONTACT HAVING AN INSERTION FUNNEL AND CONTACT SURFACE

(75) Inventors: Richard Flieger, Stammham (DE); Freddy D'Hulster, Aartrijke (BE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/204,409

(22) Filed: Dec. 2, 1998

(30) Foreign Application Priority Data

Dec. 2, 1997 (DE) ..... 197 53 459

(51) Int. Cl.[7] ..... H01R 11/22; H01R 13/11
(52) U.S. Cl. ..... 439/857; 439/839
(58) Field of Search ..... 439/833, 839, 439/843, 845, 856, 857

(56) References Cited

U.S. PATENT DOCUMENTS 5,256,088 * 10/1993 Lu et al. ..... 439/851
5,468,163 * 11/1995 Egenolf ..... 439/839
6,126,495 * 10/2000 Lolic et al. ..... 439/839

FOREIGN PATENT DOCUMENTS 196 11 698 A1 10/1997 (DE) .
0 798 810 A1 * 10/1997 (DE) ..... H01R/13/18
000571105 * 11/1993 (EP) .

* cited by examiner

*Primary Examiner*—Khiem Nguyen
*Assistant Examiner*—Michael C. Zarroli
(74) *Attorney, Agent, or Firm*—Herbert L. Lerner; Laurence A. Greenberg; Werner H. Stemer

(57) ABSTRACT

A contact spring includes a bottom spring having a centrally disposed spring arm base formed by a rectangular frame. A connection part is formed onto one end of the spring arm base, for electrical conductors. Two spring arms are each formed onto broad sides of the spring arm base on the opposite end. The spring arms converge in a wedge-like manner toward a free end and after that widen into a plug-in funnel. The spring arms are each kept spaced apart in the region of the contact zone by respective indentations oriented toward one another and disposed on long edges. A detent sleeve surrounds the spring arm base and the spring arms formed thereon. An opening angle of the plug-in funnel, over its entire length, is $\alpha \leqq 30$. The spring arms are shaped spherically in the vicinity of the contact zone and each form a respective contact dome.

14 Claims, 2 Drawing Sheets

CONTACT SPRING AND RECEPTACLE CONTACT HAVING AN INSERTION FUNNEL AND CONTACT SURFACE

BACKGROUND OF THE INVENTION

Field of the Invention

The invention relates to a contact spring. The contact spring includes the following parts: a bottom spring with a centrally disposed spring arm base formed by a rectangular frame, a connection part formed on one end of the spring arm base for electrical conductors, and two spring arms adjoining an opposite end and formed onto broad sides of the spring arm base. The spring arms converge toward one another on a free end and then open into a plug-in funnel. Respective indentations facing one another and disposed on long edges keep the spring arms spaced apart, in the vicinity of a contact zone. A detent sleeve connected to the spring arm base surrounds the spring arms.

It is well known that in disconnectable electrical contacting devices, in particular plug devices of the kind formed by a female part, such as a contact spring, and a connecting part, such as a contact blade, the contact force is of decisive significance for the reliability of the electrical connection.

There is also a demand for contact surfaces capable of good conduction, that is, which are not corroded or are non-scaling, so as to assure interference-free current transfer at the contact surface and to minimize the contact resistance.

Furthermore, disconnectable contacts constructed as a plug device should be simple to manipulate, both in the manufacture of the electrical terminals and in making the plug connection.

German Published, Non-Prosecuted Patent Application DE 196 11 698 A1 discloses a contact spring of the type defined at the outset, with resilient contact legs on both sides for contact blades intended to carry high current, in which the above demands are maximally met. However, in the use of that known contact spring, it has been found that while the contact force is still at about greater than 3 N after a certain number of plug-in operations and thus does not fall below the specified holding force for an introduced blade contact, nevertheless the requisite plugging force rises to approximately 10 N, thereby making manipulation more difficult. Under some circumstances, that can make the connection defective, or if the holding force is too low the connection can come loose or be interrupted.

SUMMARY OF THE INVENTION

It is accordingly an object of the invention to provide a contact spring, which overcomes the hereinafore-mentioned disadvantages of the heretofore-known devices of this general type, which is simple in structure and which can be manufactured at reasonable expense.

With the foregoing and other objects in view, a contact spring is provided in accordance with the invention. The contact spring comprises a bottom spring having a centrally disposed spring arm base formed by a rectangular frame. The spring arm base has broad sides and two opposite ends. A connection part is formed onto one of the ends of the spring arm base for electrical conductors. Two spring arms are each formed onto the broad sides of the spring arm base at the other ends of the spring arm base. The spring arms converge in a wedge-like manner toward a free end and then widen into a plug-in funnel in a contact zone. The plug-in funnel having an opening angle less than thirty degrees (<30°) over its entire length. The spring arms have long edges with respective indentations oriented toward one another for keeping the spring arms spaced apart in the vicinity of the contact zone. The spring arms are shaped spherically in the vicinity of the contact zone. Each spring arm forms a respective contact dome. A detent sleeve surrounds the spring arm base and the spring arms.

The wording "over its entire length" herein means that the sides or legs of the plug-in funnel extend quasi-linearly without curving or kinking. The opening angle between the legs should be as acute as possible, or in other words as small as possible.

In order to assure contact security in all cases, the spring arms are curved in a dome-like manner in the region of the contact zone. The contact zone is the region where the plug contact cooperates with the associated blade contact. Due to the curved contact surfaces of the legs, it is assured that regardless of the location of the contact blade in question when plugged in, an adequate electrical contact will always exist, so that problems in the electrical power and/or signal transmission are practically prevented.

In accordance with another feature of the invention, in order to additionally improve the contact reliability, at least the spring arms are covered on all sides with a layer of tin, and the layer thickness is approximately 1.5 $\mu$m. The tin layer is preferably applied as a so-called fire tin-plating, that is in a molten bath of tin.

It is known that while tin is a metal with good conductivity, mechanically it cannot be stressed very much, because it only affords low wear resistance due to its low strength.

In accordance with a further feature of the invention, in order to overcome that vulnerability to wear, the tin layer is mechanically consolidated through the use of stamping in the region of the contact dome.

In accordance with an added feature of the invention, through the use of this stamping, which is also called strain-hardening, the tin layer is indeed locally reduced by about 0.3 $\mu$m as compared with the non-consolidated region. This does bring about a considerable rise in wear resistance, so that the surface thus treated has less wear from friction and is abrasion-proof. In accordance with an additional feature of the invention, the tin layer has a smoothed surface. As a result, while simultaneously preserving the good corrosion protection by the tin layer, a marked reduction in the forces required to plug in and pull out the contact blades again is attained.

In accordance with yet another feature of the invention, the tin layer, at least in the mechanically consolidated region, has an intermetallic phase with a proportion of the total layer volume of 50% to 75%. This intermetallic phase additionally contributes to increasing the strength of the intrinsically very soft tin layer.

In accordance with a further feature of the invention, the spring arms of the contact spring are each formed by two parallel spring legs, which are formed onto the broad sides of the spring arm base. In accordance with an added feature of the invention, the spring legs are separated from one another by a longitudinal gap. In accordance with an additional feature of the invention, the spring legs of a spring arm, per contact spring, are joined at their free end through the use of a cross piece.

In other words, the spring arms converging in a wedge-like manner and disposed opposite one another, each have two elongated strips that each form one spring leg and are joined to the spring arm base. These spring legs are separated from one another as far as their free end by a longitudinal gap. However, the longitudinal gap is closed off on the free end by a crosspiece, for one of the two pairs of strips, each forming one spring arm.

In accordance with again another feature of the invention, each spring leg is curved spherically in the region of the contact zone and forms a contact dome, as a result of which the afore-mentioned contact reliability is not merely assured but is even improved, since the elasticity of two pairs of spring legs necessarily has a more-favorable performance than two individual spring arms.

In accordance with a concomitant feature of the invention, in a time-tested way, the detent sleeve of the contact spring cooperates in a form-locking and force-locking manner with the spring arm base and serves to secure the installation of the contact spring in existing mounting openings of housings and the like. A form-locking connection is one which connects two elements together due to the shape of the elements themselves, as opposed to a force-locking connection, which locks the elements together by force external to the elements.

Other features which are considered as characteristic for the invention are set forth in the appended claims.

Although the invention is illustrated and described herein as embodied in a contact spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
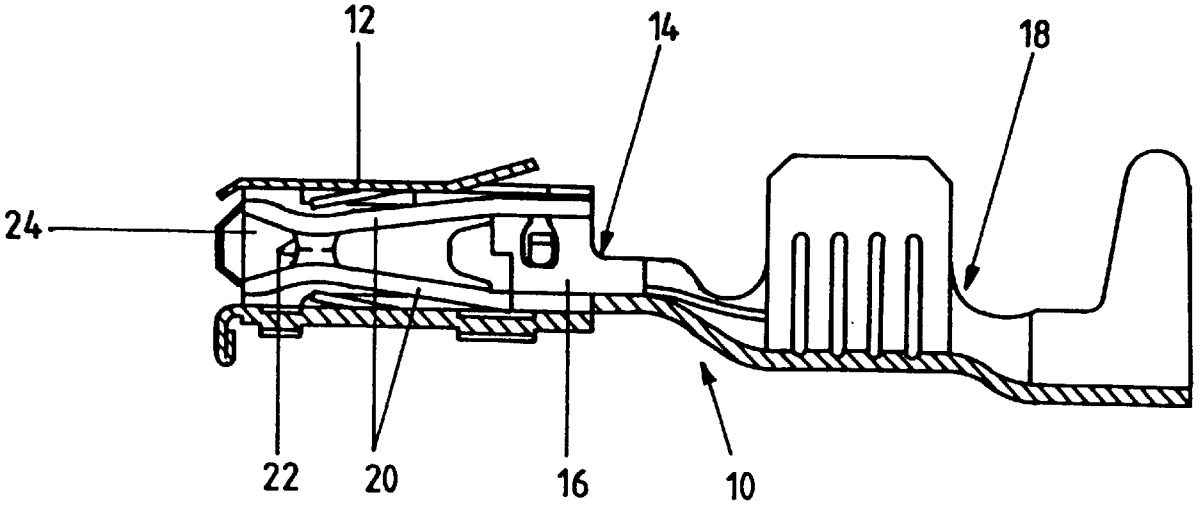
FIG. 1 is a diagrammatic, partly-sectional, side-elevational view of a contact spring according to the invention with a detent sleeve mounted thereon.

Referring now to the figures of the drawings in detail and first, particularly, to FIG. 1 thereof, there is seen a side view of a contact spring 10 according to the invention, with a detent sleeve 12 that has been slipped over a bottom spring 14 and cooperates therewith in a force-locking and form-locking manner.

The contact spring 10 is provided in a known manner with a spring arm base 16 having a rear end. A connection part 18 which is disposed on the rear end of the spring arm base 16 is already known in terms of its structure as a crimp connection, that is used to connect a non-illustrated electrical conductor.

The spring arm base 16 is formed by a box-like rectangular frame and has a front end on which spring arms 20 are formed onto flat broad sides of the spring arm base 16 in each case. The spring arms 20 have approximately equal width and correspondingly wide contact surfaces 22. The spring arms 20 have free ends which are inclined in a wedge-like manner toward one another and widen again, after approximately two-thirds to three-fourths of their length, in a funnel-like manner to form a plug-in funnel 24. As is seen in FIG. 2, the spring arms 20 are braced against one another through the use of formations 28 which are designated to as indentations and are located in side edges 26 of the spring arms 20, so that there is a certain spacing between the contact surfaces 22 of the spring arms 20.

Other features shown in FIG. 1, in particular those of the detent sleeve 12 and the connection part 18, are generally known per se from the prior art and need not be addressed in detail herein. Additionally, the same reference numerals are always used for identical features.

Figure 2:
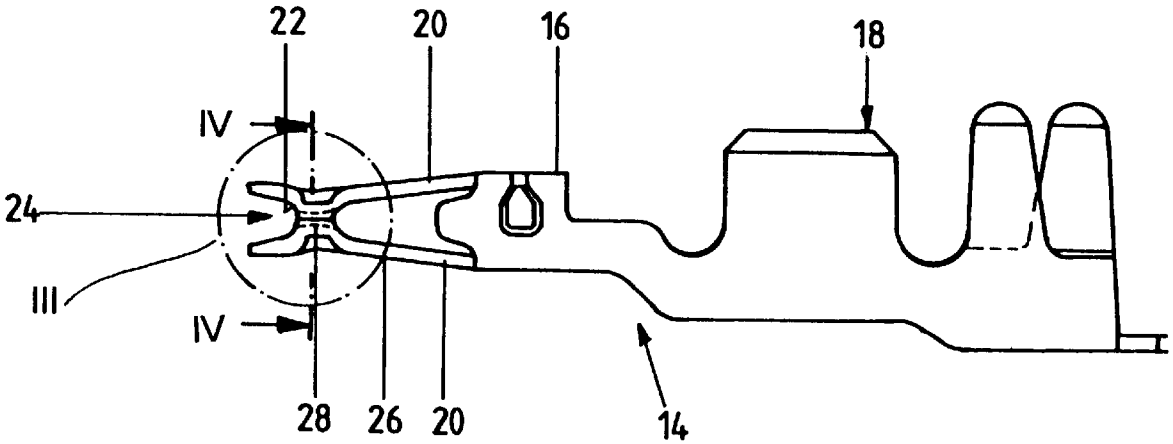
FIG. 2 is a side-elevational view of a bottom spring of a contact spring according to the invention.

FIG. 2 shows a bottom spring 14 of the contact spring 10 alone in a side view, that is without the detent sleeve 12. The structure according to the invention pertains essentially to the nature of the spring arms 20. The enlarged fragmentary view shown in FIG. 3 provides some information thereon, as does the cross section shown in FIG. 4, which is taken along a line IV—IV of FIG. 2.

Figure 3:
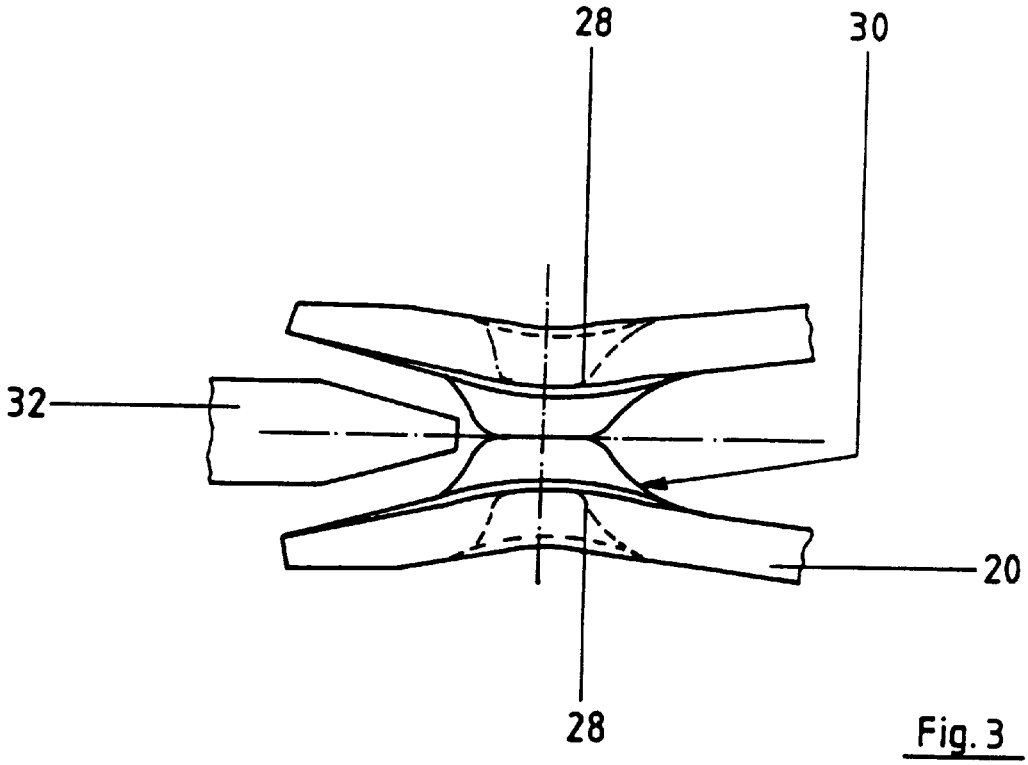
FIG. 3 is an enlarged, fragmentary, elevational view of a portion III of FIG. 2.

FIG. 3, as already noted above, shows an enlarged portion III of FIG. 2. In this drawing, the plug-in funnel 24 is shown from the side on a larger scale. From this view it becomes clear that the course of the side walls of the plug-in funnel 24 is constant from a starting point, in a thus-designated contact zone 30, to the free end, or in other words it has no kinks or curvature.

An opening angle according to the invention is at most 30°. As a result, it is advantageously attained that when an associated blade contact 32 that is diagrammatically shown in FIG. 3 is plugged in, it will not meet sides of the plug-in funnel 24 or will only meet those sides at most at the smallest possible angle. Therefore, a coating with tin which is provided according to the invention at least on the spring arms 20 will not be damaged, for example by being scraped or hit by a plug-in edge of the blade contact 32.

On the contrary, with this acute opening angle, it is attained that the contact blade 32 slides smoothly upon insertion into the contact opening formed by the spring arms resting resiliently on one another.

This very clear sliding process is promoted by the fact that the tin layer, in the region of the contact zone 30, is consolidated or in other words strain-hardened by mechanical stamping. The result that is attained on one hand is that the wear resistance of the tin, which is known to be quite soft, is increased considerably. On the other hand, the surface quality of the tin, applied in a molten bath to the contact spring 10 or at least to the spring arms 20, is improved, thus reducing the sliding resistance for the contact blade 32.

Figure 4:
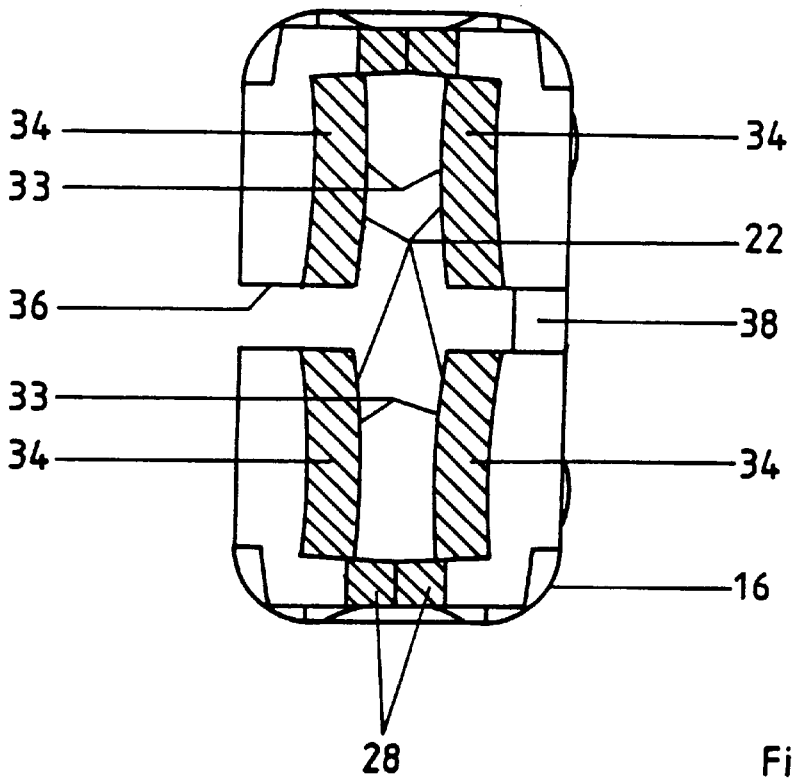
FIG. 4 is a cross-sectional view of a contact spring which is taken along a line IV—IV of FIG. 2, in the direction of the arrows.

The view shown in FIG. 4 is a cross section through the bottom spring 14 which is taken along the line IV—IV of FIG. 2. FIG. 4 discloses the fact that the spring arms 20, which are formed onto the flat broad side of the spring arm base 16, are shaped spherically at least in a region of the section or plane that intersects the contact zone 30 and each form one contact dome 33. It is also shown that the spring arms 20 are constructed as strip-like lower spring legs 34, which are separated from one another by a gap 36.

It can also be seen in FIG. 4 that the lower spring legs 34 are joined together through the use of a crosspiece 38, which is disposed on their free end. As a result, the bottom spring 14 of the contact spring 10 of the invention is given improved stability, which is reinforced by the detent sleeve 12 surrounding both the spring arms 20 and the spring arm base 16.

It can also be seen from FIG. 4 that the spring legs 34 are spherically curved in the region of the contact zone 30 and form the contact dome 33.

The aforementioned tin layer is not shown in detail in FIGS. 1–4, since it has a thickness of only a few micrometers, preferably approximately 1.5 μm. Nevertheless, this circumstance should not be understood to mean that the tin layer is of no significance for the invention. On the contrary, as explained above, both the tin layer and its strength-increasing and surface-improving treatment are of considerable significance for the present contact spring 10 according to the invention.

We claim:

1. A contact spring, comprising:

a bottom spring having a centrally disposed spring arm base formed by a rectangular frame, said spring arm base having broad sides and two opposite ends;

a connection part formed onto one of said ends of said spring arm base for electrical conductors;

two spring arms each formed onto said broad sides of said spring arm base at the other of said ends of said spring arm base, said spring arms converging in a wedge-like manner toward a free end and then widening into a plug-in funnel in a contact zone, said plug-in funnel having an opening angle ≦30° over its entire length, said spring arms having long edges with respective indentations oriented toward one another for keeping said spring arms spaced apart in the vicinity of said contact zone, and said spring arms shaped spherically in the vicinity of said contact zone and each forming a respective contact dome; and a detent sleeve surrounding said spring arm base and said spring arms.

2. The contact spring according to claim 1, wherein at least said spring arms are covered on all sides with a layer of tin.

3. The contact spring according to claim 2, wherein said tin layer is mechanically consolidated by stamping in the vicinity of said contact dome.

4. The contact spring according to claim 2, wherein said tin layer has a smoothed surface.

5. The contact spring according to claim 3, including a non-consolidated region, said tin layer approximately 0.3 μm less in the vicinity of said contact dome than in said non-consolidated region, because of said mechanical consolidation.

6. The contact spring according to claim 3, wherein said tin layer, at least in said mechanically consolidated region, has an intermetallic phase with a proportion of 50% to 75% of a total layer volume.

7. The contact spring according to claim 1, wherein said spring arms formed onto said broad sides of said spring arm base are each formed by two parallel spring legs.

8. The contact spring according to claim 7, wherein said spring legs of one of said spring arms are separated from one another by a longitudinal gap.

9. The contact spring according to claim 7, wherein said spring legs of said spring arms have a free end, and a cross piece joins said free ends of said spring legs together.

10. The contact spring according to claim 7, wherein each of said spring legs is curved spherically in the vicinity of said contact zone and forms said respective contact dome.

11. The contact spring according to claim 1, wherein said detent sleeve form-lockingly and force-lockingly cooperates with said spring arm base.

12. A receptacle contact, comprising:

a bottom spring having a centrally disposed spring arm base formed by a rectangular frame, including spring arm base broad sides and two opposite ends;

a connection part for electrical conductors formed onto one of said opposite ends;

two spring arms, each formed onto a respective one of said broad sides at the other of said opposite ends of said spring arm base, said two spring arms converging toward a contact zone and then widening to define a plug-in funnel having an opening angle no greater than thirty degrees over its entire length, said two spring arms each having long edges with respective indentations oriented toward one another for keeping said spring arms spaced apart in the vicinity of said contact zone, said spring arms being formed with a spherical shape in said vicinity with each of said spring arm forming a contact dome; said spring arms having a layer of tin in said vicinity of said contact zone being locally reduced in thickness by about three-tenths of a micrometer in the area of said contact dome through mechanical consolidation; and a detent sleeve surrounding said spring arm base and said spring arms.

13. A contact spring, comprising:

a bottom spring having a centrally disposed spring arm base formed by a rectangular frame, said spring arm base having broad sides and two opposite ends;

a connection part formed onto one of said ends of said spring arm base for electrical conductors;

two spring arms each formed onto a respective one of said broad sides of said spring arm base at the other of said ends of said spring arm base, said spring arms converging in a wedge-like manner toward a free end and then widening into a plug-in funnel in a contact zone, said plug-in funnel having an opening angle ≦30° over its entire length, said spring arms having long edges with respective indentations oriented toward one another for keeping said spring arms spaced apart in the vicinity of said contact zone, and said spring arms shaped spherically in the vicinity of said contact zone and each forming a respective contact dome;

a detent sleeve surrounding said spring arm base and said spring arms; and a tin layer covering at least said spring arms on all of said sides, said tin layer including a non-consolidated region and a consolidated region being mechanically consolidated by stamping in the vicinity of said contact dome, said consolidated region being approximately 0.3 μm thinner than said non-consolidated region.

14. A contact spring, comprising:

a bottom spring having a centrally disposed spring arm base formed by a rectangular frame, said spring arm base having broad sides and two opposite ends;

a connection part formed onto one of said ends of said spring arm base for electrical conductors;

two spring arms each formed onto a respective one of said broad sides of said spring arm base at the other of said ends of said spring arm base, said spring arms converging in a wedge-like manner toward a free end and then widening into a plug-in funnel in a contact zone, said plug-in funnel having an opening angle ≦30° over its entire length, said spring arms having long edges with respective indentations oriented toward one another for keeping said spring arms spaced apart in the vicinity of said contact zone, and said spring arms shaped spherically in the vicinity of said contact zone and each forming a respective contact dome;

a detent sleeve surrounding said spring arm base and said spring arms; and a tin layer covering at least said spring arms on all of said sides and defining a layer volume, said tin layer including a non-consolidated region and a consolidated region being mechanically consolidated by stamping in the vicinity of said contact dome; said consolidated region, having an intermetallic phase, said intermetallic phase containing 50% to 75% of said layer volume.

* * * * *